US009743761B1

(12) United States Patent
O'Day

(10) Patent No.: US 9,743,761 B1
(45) Date of Patent: Aug. 29, 2017

(54) ERGONOMIC LOCKER SYSTEM

(71) Applicant: Steven J. O'Day, Hammond, IN (US)

(72) Inventor: Steven J. O'Day, Hammond, IN (US)

( * ) Notice: Subject to any disclaimer, the term of this patent is extended or adjusted under 35 U.S.C. 154(b) by 0 days.

(21) Appl. No.: 15/340,406

(22) Filed: Nov. 1, 2016

(51) Int. Cl.
*A47B 77/00* (2006.01)
*A47B 61/00* (2006.01)

(52) U.S. Cl.
CPC ..... *A47B 61/003* (2013.01)

(58) Field of Classification Search
CPC ..... A47B 61/003
See application file for complete search history.

(56) References Cited

U.S. PATENT DOCUMENTS 963,346 A 7/1910 Wilt
1,391,495 A 9/1921 Parsons
1,510,056 A * 9/1924 Hamson ..... A47B 61/003 211/97
1,706,683 A * 3/1929 Victorsohn ..... A47B 61/003 206/289
1,751,777 A * 3/1930 Victorsohn ..... A47B 61/003 190/13 R
1,892,794 A 1/1933 Wertzler
1,997,490 A * 4/1935 Hoar ..... A47B 61/003 211/124
2,068,451 A * 1/1937 Elmore ..... A47B 61/003 211/124
2,379,975 A * 7/1945 Luger ..... D06F 57/12 211/97
2,396,751 A * 3/1946 Resnick ..... A47G 25/746 211/124
D158,154 S * 4/1950 Tritt ..... 211/123
2,606,667 A * 8/1952 Hornick ..... A47K 10/10 188/69
3,360,321 A * 12/1967 Novales ..... A47B 47/03 211/153
4,775,056 A * 10/1988 Inglis ..... A63B 1/005 211/100
5,011,029 A * 4/1991 Sugasawara ..... A47B 61/003 16/54
5,306,077 A * 4/1994 Trevaskis ..... A47B 88/483 312/122
5,337,905 A 8/1994 Gast
(Continued)

FOREIGN PATENT DOCUMENTS

CN 202919489 U 5/2013
CN 203563884 U 4/2014
(Continued)

OTHER PUBLICATIONS

Arsenal Pro Gold Counter-Balanced Smith Machine, Aug. 2016, pp. 1-10, www.raecrowther.com.

*Primary Examiner* — Hanh V Tran
(74) *Attorney, Agent, or Firm* — C. John Brannon; Brannon Sowers & Cracraft PC

(57) ABSTRACT

The present invention embodies an ergonomic locker system comprising a repositionable cross-member or bar for supporting a plurality of triangular clothes hangers suspended between two oppositely disposed tracks. The hanging bar is slideable along the tracks and may be adjusted from a lower, forward position to a higher, back position in order to enhance storage space and improve functionality.

7 Claims, 6 Drawing Sheets

(56) References Cited

U.S. PATENT DOCUMENTS

| | | | | |
|---|---|---|---|---|
| 5,421,646 | A * | 6/1995 | McNamara | A47B 96/025 108/102 |
| 5,951,126 | A * | 9/1999 | Wolff | A47B 47/0033 312/108 |
| 6,381,771 | B1 * | 5/2002 | Kelly | A47K 3/003 211/105.1 |
| 6,394,289 | B1 | 5/2002 | Panchihak et al. | |
| 7,086,544 | B1 | 8/2006 | Doench | |
| 7,316,324 | B1 * | 1/2008 | Myllykangas | A47K 10/04 211/105.1 |
| 7,780,018 | B1 * | 8/2010 | Sauder | A47B 57/10 108/147.16 |
| 2006/0118505 | A1 | 6/2006 | Walter | |
| 2013/0099073 | A1 | 4/2013 | Bradbury | |
| 2014/0034643 | A1 * | 2/2014 | Canfield | B65D 85/00 220/212 |

FOREIGN PATENT DOCUMENTS

| | | | |
|---|---|---|---|
| CN | 204541335 | U | 8/2015 |
| CN | 105310289 | A | 2/2016 |
| JP | 0658731 | U | 8/1994 |
| JP | 2000245610 | A | 9/2000 |
| KR | 20120005551 | U | 8/2012 |

* cited by examiner

ERGONOMIC LOCKER SYSTEM

TECHNICAL FIELD

The present novel technology relates generally to the storage furniture industry, and, more particularly, to a commercial locker with a repositionable support bar.

BACKGROUND

On-site storage lockers have been used to store clothing in the workplace, school hallways, golf clubhouses, athletic locker rooms, and like places. However, lockers have been limited in their versatility to accommodate larger amounts of clothing in an organized fashion. Most lockers are too narrow and/or too shallow to allow for a plurality of jackets, shirts, and the like to fit within in locker while still allowing access to other stored items and for the locker door to be closed.

Thus, there is a need for a system that allows those using or otherwise needing access to a clothing locker, such as a typical worker, student, club member, athlete, and/or uniform supplier or route driver to store a larger volume of clothing and other non-clothing items more efficiently within their locker.

DETAILED DESCRIPTION OF THE PREFERRED EMBODIMENT

Figure 1:
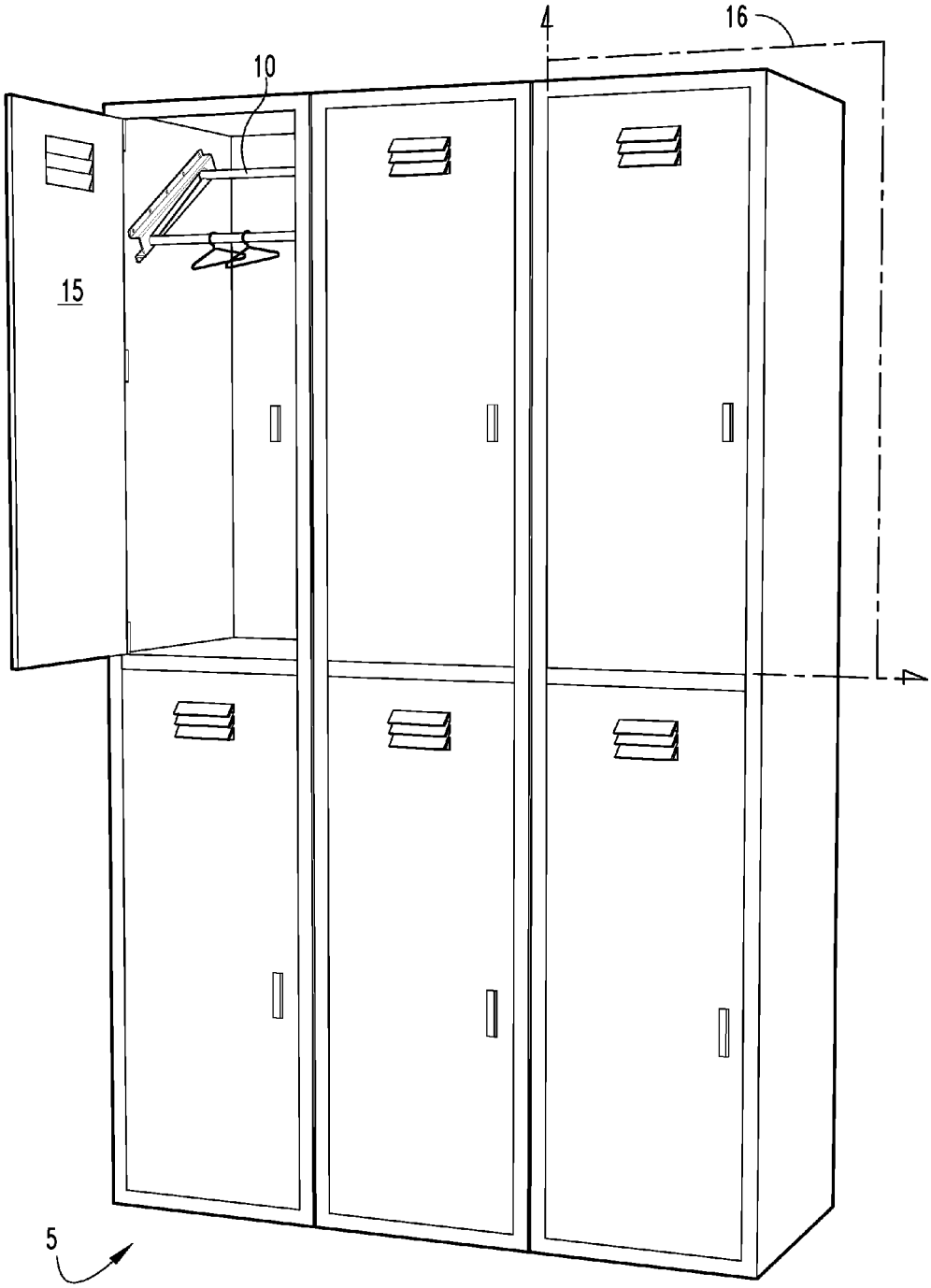
FIG. 1 is an exterior perspective view of a first embodiment of an ergonomic storage locker according to the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2:
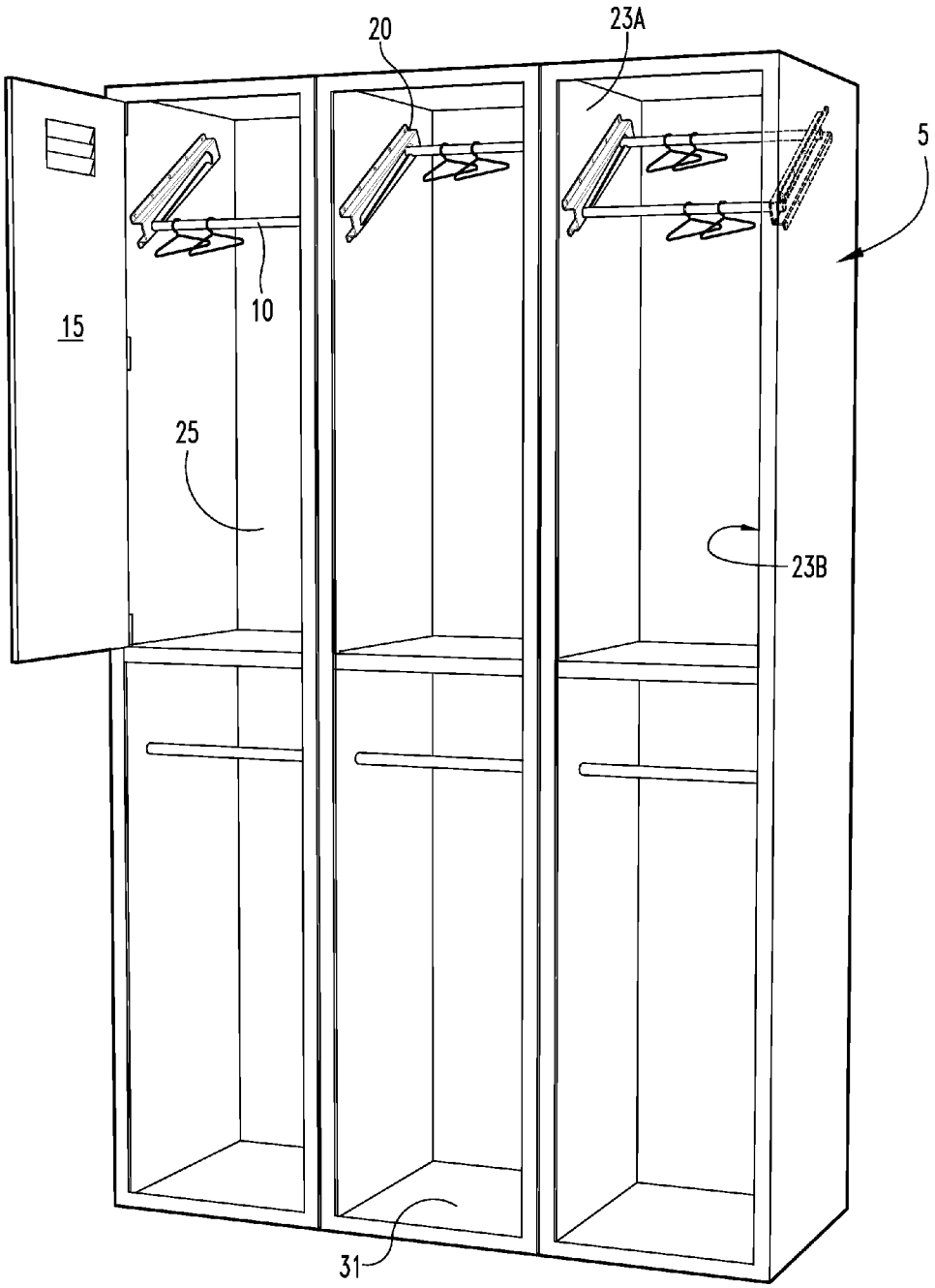
FIG. 2 is a cutaway interior view of the embodiment of FIG. 1.
Figure 3:
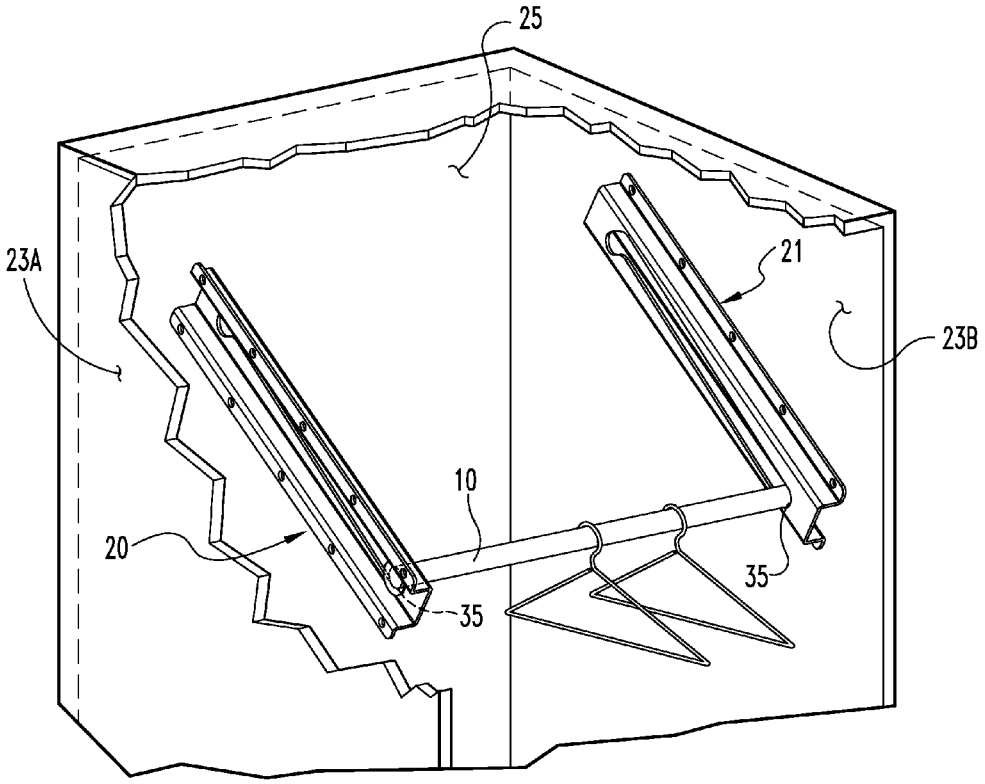
FIG. 3 is a first enlarged partial view of the embodiment of FIG. 2.
Figure 4:
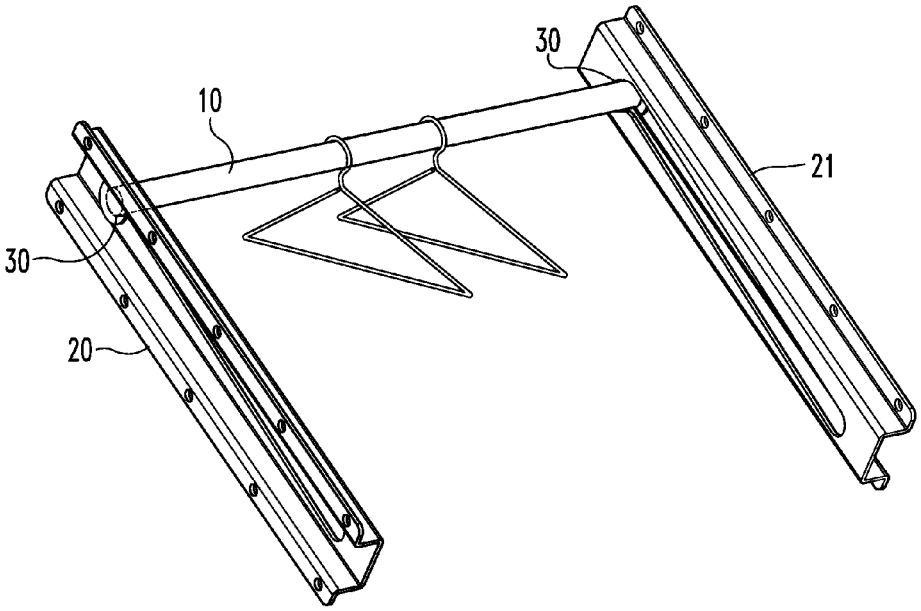
FIG. 4 is a second enlarged partial view of the embodiment of FIG. 2.
Figure 5:
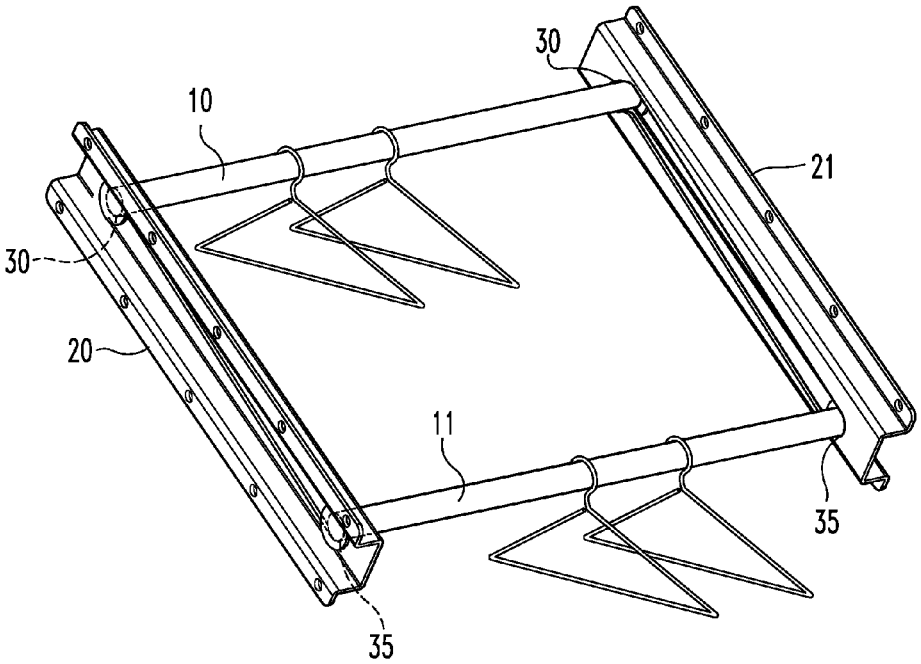
FIG. 5 is a third enlarged partial view of the embodiment of FIG. 3.
Figure 6:
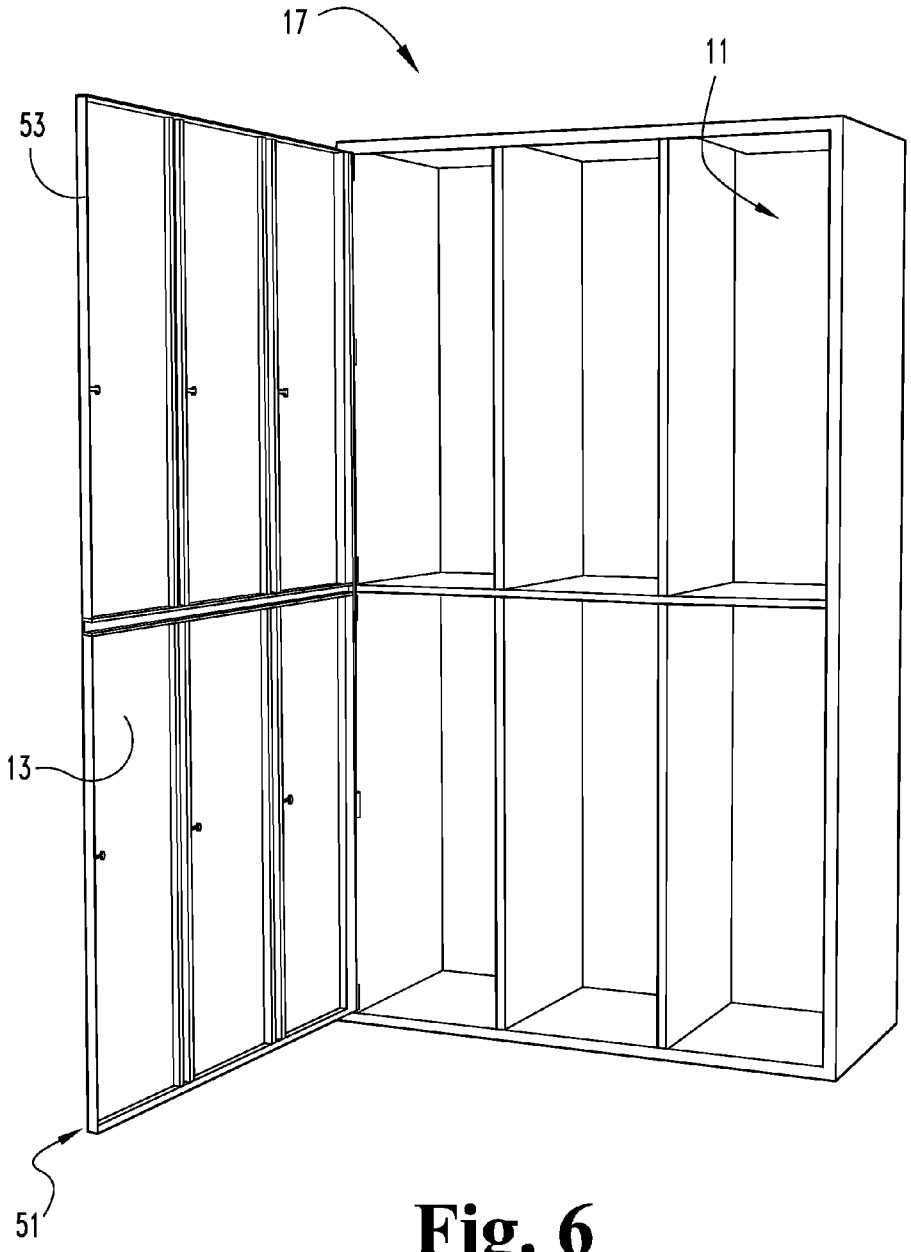
FIG. 6 is a perspective view of FIG. 1 showing the master door open.
Figure 7:
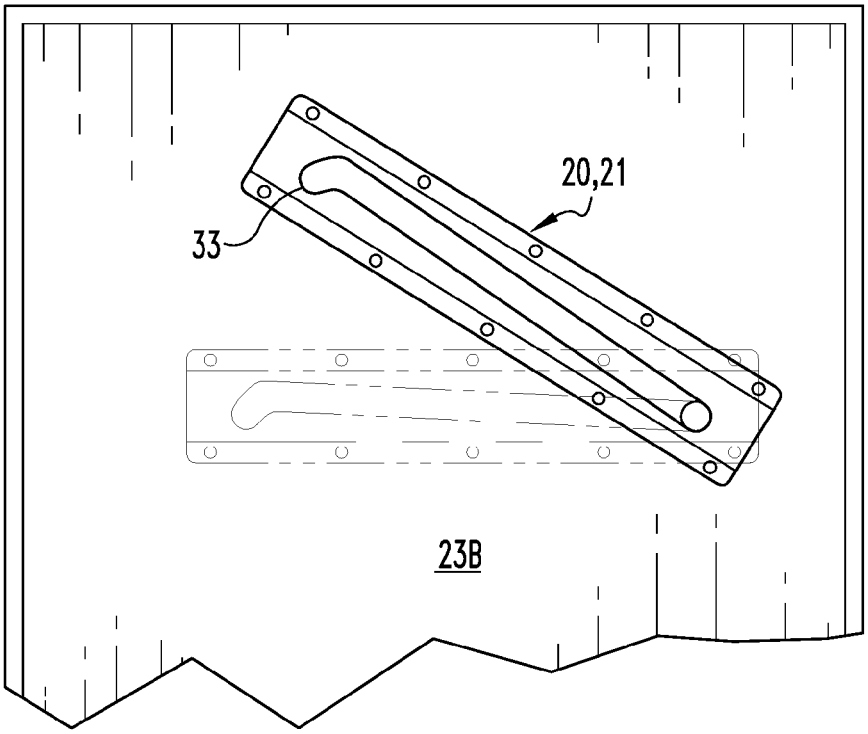
FIG. 7 is an enlarged perspective view of a track and locking mechanism.

The novel technology shown in FIGS. 1-7 illustrate an ergonomic locker system 5 having a repositionable cross-member or bar 10 extending across the interior volume 11 of an individual locker unit 13 that is typically arranged as one of a plurality of units 13 defining a locker bank 17. The bar 10 is typically capable of supporting a plurality of hangers, such as triangular clothes hangers or the like. The bar 10 is suspended between two tracks 20, 21 that are respectively position on oppositely disposed sides 23A, 23B of the locker unit 13. The tracks 20, 21 are typically diagonally oriented with respect to the front wall or door 15 in its pivoted closed position (i.e., the front door plane 16) and rear wall 25 of the locker 5, typically running upwardly from the front portion 15 of the locker to the rear portion 25.

The locker bank 17 typically includes a plurality of elongated locker units 13 positioned side-by-side and connected at adjacent walls or side members 23A, 23B. In some instances, each locker unit 13 is full length or about five to seven feet tall with the bank 17 having a single row of units 13, while in other instances, each locker unit 13 is half-size or about three feet tall, with the bank 17 having two or more rows of units 13, with the second row stacked atop the first, and so on.

Typically, for full length units 13 and/or half-length units 13 positioned on upper rows, the bar 10 is slideable from a typically lower, proximal position 35 on the tracks 20, 21 to a typically higher, distal position 30 on the tracks 20, 21. For lower units, the bar 10 is typically slideable between a first proximal position 35 to a recessed distal position 30 along a horizontal path or even a path that descends slightly from proximal position 35 to horizontal position 30. The bar 10 is typically lockable into the proximal or lower position 35 or distal or higher position 30, such as via locking notch 33 formed in one or both respective tracks 20, 21.

In the case of full length or upper row units 13, the slideable bar 10 allows for users to hang their clothes in the locker 5 when the bar 10 is in the lower, proximal position 35, and then slide the bar 10 into the higher, distal position 30 and lock it there for storage so that the hanging clothes are repositioned up and out of the way of access to the remaining locker volume. With the clothes in this recessed, typically higher position, the locker door 15 is able to more easily close and items stored on the floor or shelves of the remaining locker volume are more easily accessible. Workers, students, and the like, will no longer have to reach up into the back of a locker to load and unload hangers, putting additional, daily wear and tear on the arms, shoulders, and back. The ergonomics involved in the novel technology provide everyday users of an individual locker, and especially bulk users, such as uniform supply employees and the like, an easier way to access clothing by sliding the bar 10 towards them, decreasing the likelihood of work-related injuries from acute or repetitive stressors.

Similarly, for shorter units 13 located lower to the ground, the slideable bar 10 allows for users to hang clothes in the locker 5 when the bar 10 is in the forward, proximal position 35 and then slide the bar 10 into the rearward, distal position 30 and lock it there for storage so that the hanging clothes are repositioned back and out of the way of access to the remaining locker volume. Tracks 20, 21 are thus oriented at (or nearly) horizontal, with only a slight incline or decline from proximal end or position 35 to distal end or position 30.

The locker bank 17 typically has a master door 51, which typically includes the front doors 15 of all of the locker units 13 making up the bank 17 positioned within a framework 53. The master door 51 is pivotably connected to the bank 17 such that it may be opened to expose the interior volumes 11 of all locker units 13 that are members of the bank 17.

In one embodiment, the bar 10 is typically disposed seventy-five inches from the base 31 of the locker 5 and three and a half inches into the locker 5 volume or from the front door plane 16 in the first, lower position 35. In the second, elevated position 30, the bar 10 is typically disposed eighty-two inches from the base member or floor 31 of the locker 5 and eleven and a half inches into the locker 5 volume or from the front door plane 16. Of course, in other embodiments the dimensions may be different.

Additionally, a second removable bar 11 may be added or inserted into the lower, proximal position 35 while the first bar 10 is locked in the higher, distal position 30. This removable bar 11 is manually removed from the proximal position 35 prior to sliding the bar 10 from the distal position 30 into the proximal position 35. This arrangement temporarily expands the storage capacity of the locker 5.

In operation, a user can access the locker volume by first opening the pivotably front door 15 and then moving the bar 10 into the proximal position 35. It may first be necessary to unlock the bar 10 if the bar is locked in its distal position 30. Once the bar 10 is proximally disposed, clothes may be removed from and/or added to the bar 10, such as by undraping/draping over hangers that may be removably suspended from the bar 10. The bar 10 is then repositioned to the distal position 30 and, typically, locked in place. Finally, the locker door 15 is pivoted shut and secured.

Optionally, after repositioning the bar 10, a second bar 11 may be inserted into the proximal position 35 to increase the storage capacity of the locker system 10.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A locker system comprising:

a plurality of adjacently disposed lockers, each respective locker defining a respective base portion; first and second respective parallel sidewalls extending orthogonally from the respective base portion; a respective back wall extending between the respective sidewalls; and a respective front door disposed opposite the back wall and pivotably connected to a master door member;

a respective first elongated track connected to each respective first sidewall;

a respective second, oppositely disposed elongated track connected to each respective second sidewall;

a respective first elongated member for supporting a plurality of clothing hangers and operationally connected between each two respective oppositely disposed, elongated tracks;

wherein each respective front door is pivotable between a closed position and an open position;

wherein each respective first elongated member is slideable between a respective first, proximal and lower position adjacent a respective front door and a respective second, distal and elevated position adjacent a respective back wall;

wherein each respective first elongated member may be locked into the respective second position; wherein the tracks are diagonally oriented with respect to each respective front door and back wall.

2. The system of claim 1 wherein, in the first position, the first elongated member is disposed seventy-five inches from the base portion and three and a half inches from the front door when the front door is in the closed position; and wherein, in the second position, the first elongated member is disposed eighty-two inches from the base portion and eleven and a half inches from the front door when the front door is in the closed position.

3. The system of claim 1 wherein the first elongated member is in the second positions; and further comprising a second elongated member in the first position.

4. A locker system comprising:

a plurality of adjacently disposed lockers defining a row, wherein each respective locker further comprises:

first and second spaced parallel sidewalls;

a back wall extending between the respective sidewalls;

a front door plane disposed opposite the back wall and between the respective sidewalls;

a base portion connected to the respective spaced sidewalls and the back wall;

a first elongated track connected to the first sidewall;

a second, oppositely disposed elongated track connected to the second sidewall; and an elongated member for supporting a plurality of clothing hangers, operationally connected between the two oppositely disposed, elongated tracks;

a frame portion pivotably connected to the row;

a plurality of locker doors operationally connected to the frame portion, wherein each respective door occupies a respective front door plane;

wherein the elongated member is repositionable between a first, proximal and lower position adjacent the front door plane and a second, distal and elevated position adjacent the back wall;

wherein the elongated member may be locked into the second position;

wherein the tracks are diagonally oriented with respect to the front door plane and back walls;

wherein the first position is disposed seventy-five inches from the base portion and three and a half inches from the front door plane;

wherein the second position is disposed eighty-two inches from the base portion and eleven and a half inches from the front door plane.

5. A method for using an ergonomic locker system:

a) providing an ergonomic locker system, wherein the system further comprises:

a plurality of individual locker units, each respective unit defining a base member, respective first and second parallel sidewalls extending from the base member, a respective back wall extending between the respective sidewalls, and a front door plane disposed between the respective sidewalls and positioned opposite and parallel to the back wall, and a respective front door positioned between the respective sidewalls in the front door plane;

a respective first elongated track connected to each respective first sidewall;

a respective second spaced elongated track connected to each respective second sidewall;

a respective elongated member for supporting a plurality of clothing hangers and operationally connected between respective first and second elongated tracks;

a master door member positioned in the front door plane and pivotably connected to each respective front door;

wherein each respective elongated member is slideable between a first, proximal and lower position adjacent a respective front door and a second, distal and elevated position adjacent a respective back wall;

wherein each respective elongated member may be locked into the second position; wherein the tracks are diagonally oriented with respect to each respective front door and back wall; and b) simultaneously accessing all of the lockers in the locker system by opening the master door;

c) positioning each respective elongated member in the lower, proximal position;

d) accessing clothing suspended from the respective elongated members;

e) positioning each respective elongated member in the higher, distal position.

6. The method of claim 5 and further wherein comprising the additional steps of:

f) adding hangers to a respective elongated member while the respective elongated member is in the lower, proximal position; and g) removing hangers from the respective elongated member while the respective elongated member is in the lower, proximal position.

7. The method of claim 5 and further wherein comprising the additional steps of:

h) adding a second elongated member to a respective lower, proximal position.

* * * * *